US005150885A

United States Patent [19]

Leone

[11] Patent Number: 5,150,885

[45] Date of Patent: Sep. 29, 1992

[54] PICKET FENCE ASSEMBLY

[76] Inventor: Nicola Leone, 5652 - 8th Line, R.R. #2, Hornby, Ontario, Canada, L0P 1E0

[21] Appl. No.: 687,347

[22] Filed: Apr. 18, 1991

[51] Int. Cl.[5] ..... E04H 17/16

[52] U.S. Cl. ..... 256/22; 256/65; 52/667

[58] Field of Search ..... 256/22, 21, 65, 1; 403/348, 349; 52/668, 667, 666

[56] References Cited

U.S. PATENT DOCUMENTS 1,811,370 6/1931 Soucy ..... 256/22
3,113,760 12/1963 Huret et al. ..... 256/21 X
3,736,714 6/1973 Brenner ..... 403/349 X
4,883,256 11/1989 Hebda ..... 256/22
4,898,365 2/1990 Conner et al. ..... 256/22 X

*Primary Examiner*—Peter M. Cuomo
*Attorney, Agent, or Firm*—Arne I. Fors

[57] ABSTRACT

An improved picket fence is disclosed, comprising a plurality of vertical pickets, each extending through an aperture in an upper rail and a corresponding aperture in a lower rail, the rails being provided with a frictional abutment, into which the pickets are rotated, enabling frictional abutment of the rails with the pickets in such a way as to resist further movement of the pickets relative to the rails.

3 Claims, 3 Drawing Sheets

PICKET FENCE ASSEMBLY

FIELD OF THE INVENTION

This invention relates to an improved picket fence assembly, wherein each picket is inserted through vertically aligned apertures in a pair of upper and lower rails, and rotated such that the pickets frictionally abut with the rails so as to "lock" the pickets into place, preventing further axial or rotational movement of the pickets relative to the rails.

BACKGROUND OF THE INVENTION

The manufacture and assembly of ornamental and security iron picket fences has been gradually improved upon in the prior art, resulting in fences which are cheaper to manufacture and easier to install.

Van Dorn, U.S. Pat. No. 189,543, discloses a picket fence assembly in which pickets have a notch on at least one side thereof, the notch providing a shoulder which engages with the edge of a horizontal rail when the pickets are inserted into holes in the rails. The holes in the rails correspond to the shape and size of the picket in cross section and the shoulders of the pickets engage the rails when the pickets are rotated one-quarter turn. In one embodiment a collar slides over the picket and wedges between the picket and the rail on all sides of the picket, thereby further securing the picket in place. A rigid overall structure is created. End support posts attach to the rails with a grooved wedge and secure the fence against vertical and longitudinal displacement. Vertical and lateral adjustments are made by adjusting the wedge connections between rails and posts and rails and pickets respectively.

Wedges must be placed in each rail-picket joint to prevent rotation and loosening of the pickets. Wedges may become loosened over time and with exposure to the elements, and may require replacement, resulting in increased expense.

Hebda, U.S. Pat. No. 4,883,256, discloses a picket fence and method of construction. The pickets are non-circular, and are inserted through corresponding holes in upper and lower rails. The holes are of the same shape and size as the cross sections of the pickets. The pickets are notched at the level of the upper rail and at the level of the lower rail at each corner so as to enable engagement of the pickets with both of the rails, which prevents vertical displacement of the pickets. The pickets have transverse through-holes which are aligned and receive a rigid transverse rod, thereby preventing rotation and vertical and lateral displacement of the pickets. The rod serves to stabilize the structure and to render the fence less susceptible to surreptitious disassembly, thereby increasing the security function of the fence.

Use of a rod to lock the picket into place adds manufacturing costs in terms of the cost of the rods and the costs of adapting the pickets to receive the rod, and increased labour cost due to the requirement that the pickets must be accurately aligned in order to pass the rod through them. Difficulty with alignment and insertion of the transverse rod would be anticipated in the case of hilly terrain or irregularly constituted terrain.

The present invention improves upon the prior art by preserving the functional advantages set out in the prior art, such as vertical and lateral stability and protection against surreptitious disassembly, while reducing both manufacturing and assembly costs and simplifying the assembly process. The present invention provides an improved structure which prevents further movement of pickets subsequent to initial rotation from an "assembly position" into a "locking position". Furthermore, the present invention may be assembled with ease on any type of terrain.

SUMMARY OF THE INVENTION

The disadvantages of the prior art may be overcome by providing a picket fence assembly having upper and lower rails, the rails having frictional abutment means which lock the pickets in place, preventing further movement thereof, to resist unintended or surreptitious disassembly.

In one aspect of the invention, there is provided a picket fence assembly comprising C-shaped upper and lower rails each having a plurality of non-circular apertures therethrough in substantial vertical alignment and a plurality of vertically disposed pickets, each extending through one of the apertures in the upper rail and through one of the aligned apertures in the lower rail. The pickets have thereon upper and lower indentations for engaging the upper and lower rails. The pickets are respectively held in said apertures and are axially movable in said apertures to a locking position at which the indentations in the pickets are engaged by the rails and axial movement of said pickets relative to said rails is prevented. The rails are provided with a frictional locking means, such that said pickets are engaged in a frictional fit therewith in said locking position wherein rotational movement of said pickets is restrained. The frictional locking means comprises a plurality of paired opposed indentations in the flanges of the rails. The indentations conform with the perimeter configuration of said pickets in said locking position.

BRIEF DESCRIPTION OF THE DRAWINGS

In drawings which illustrate the embodiments of the invention.

DETAILED DESCRIPTION OF A PREFERRED EMBODIMENT OF THE INVENTION

Figure 1:
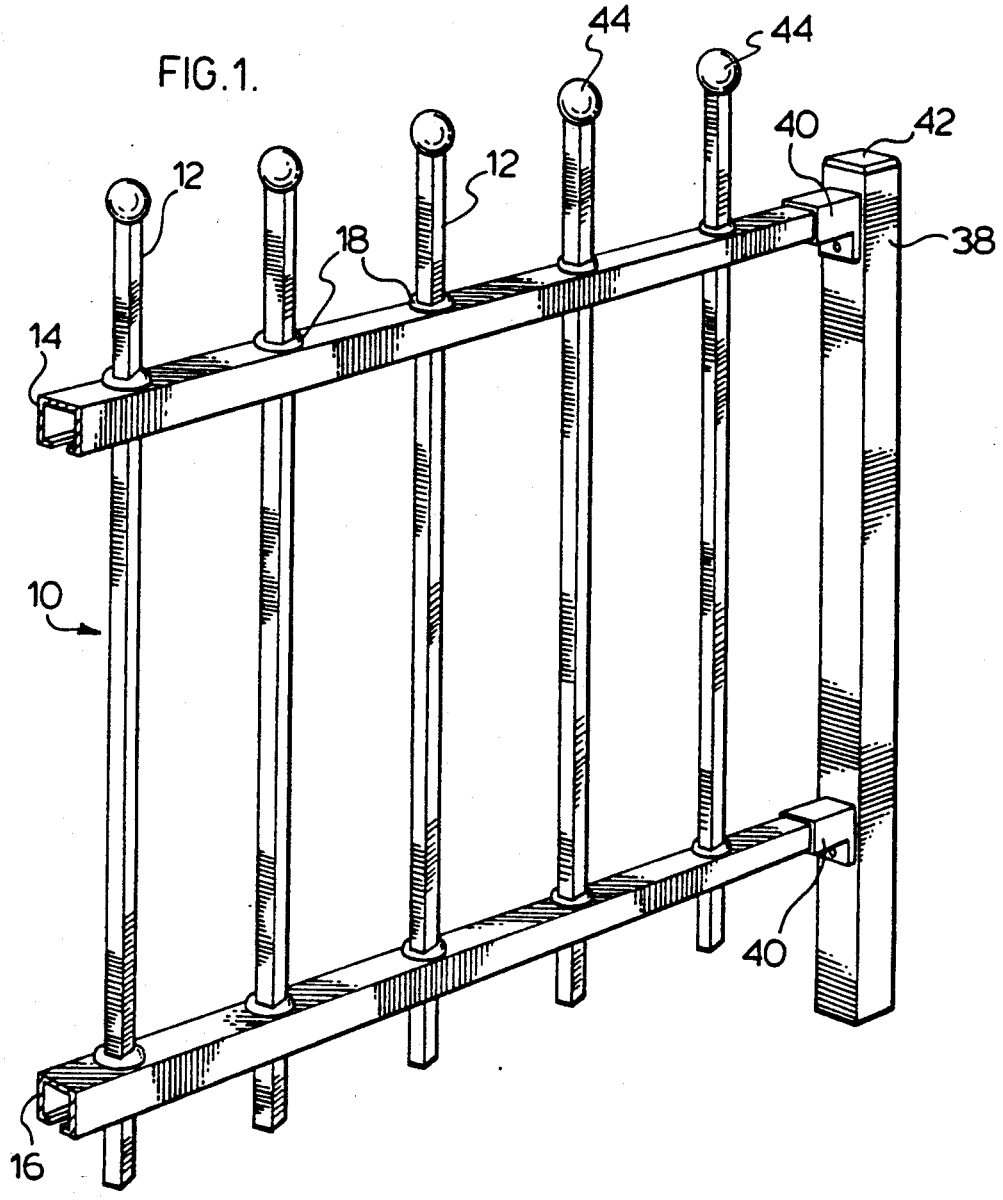
FIG. 1 is a perspective view of the picket fence embodying the present invention.
Figure 2:
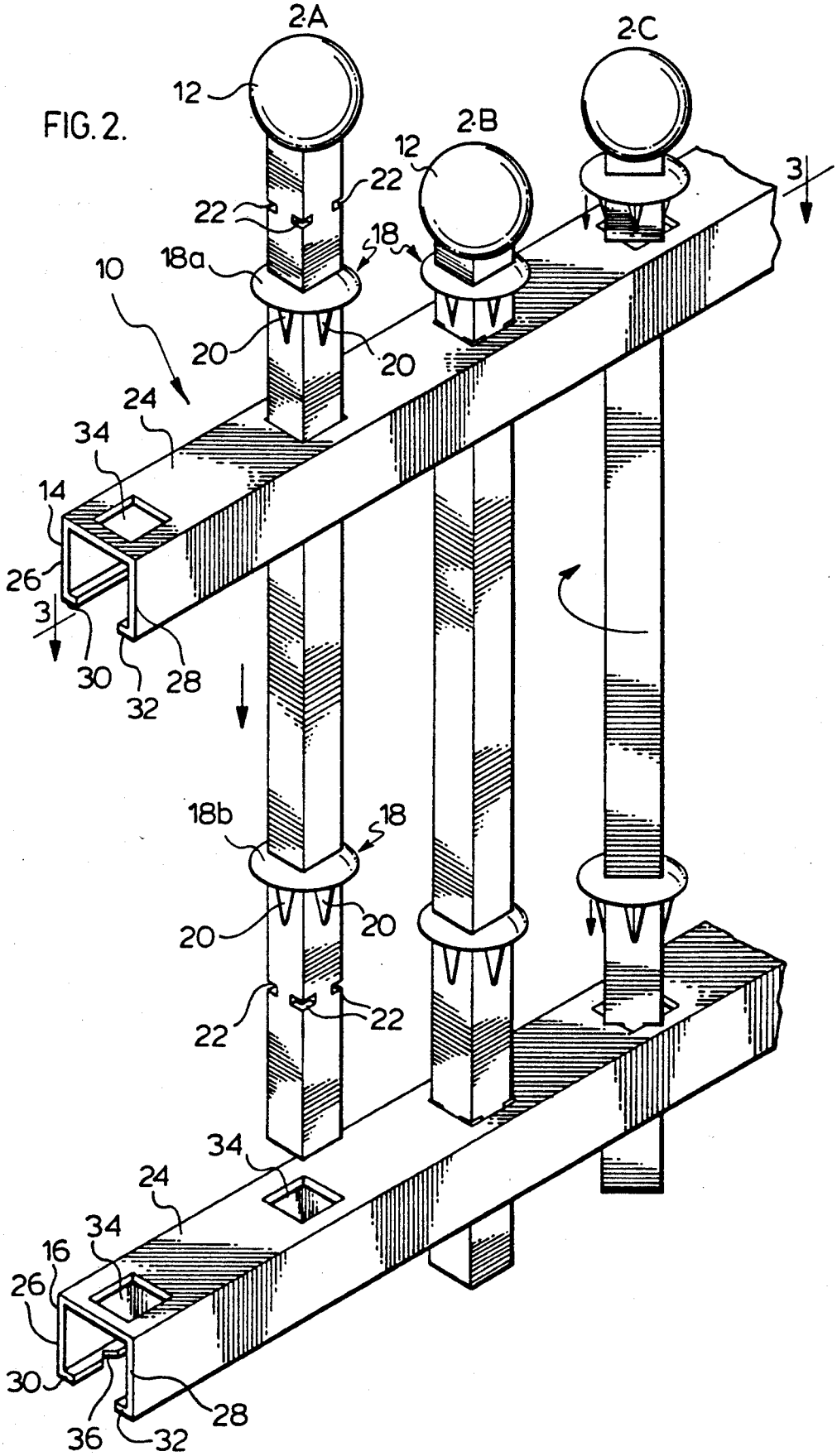
FIG. 2 is a magnified perspective view of the picket fence assembly of FIG. 1, depicting 3 stages of picket insertion, 2-A, 2-B, and 2-C.

The invention is generally illustrated in FIG. 1. In the preferred embodiment the picket fence 10 comprises a plurality of pickets 12, an upper rail 14 and a lower rail 16. As shown in FIG. 2, each picket 12 has upper and lower ornamental caps 18 having a plurality of tabs 20. Pickets 12 have a uniform square cross-section and have indentations 22 formed in the corners.

Figure 3:
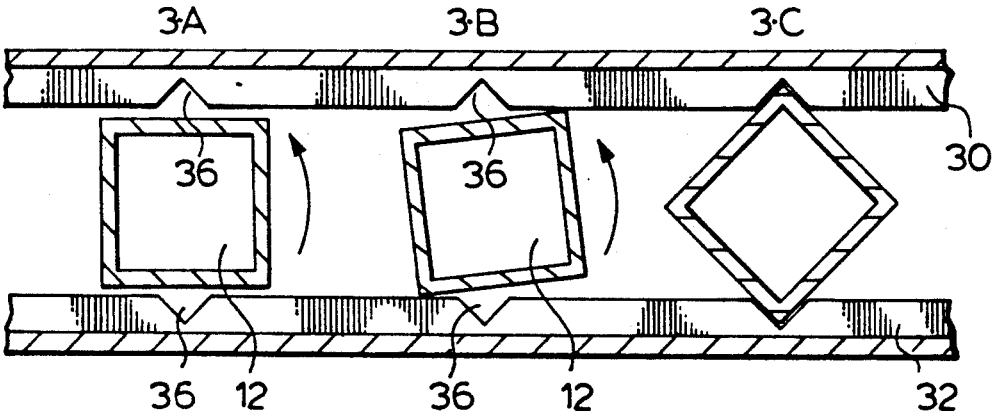
FIG. 3 is a longitudinal sectional view of line 3—3 of the picket fence assembly of FIG. 2, wherein 3-A is the cross section of 2-A, 3-B is the cross section of 2-B and 3-C is the cross section of 2-C.

The upper and lower rails 14 and 16 are identical and C-shaped, having an upper web 24, sides 26 and 28 and opposed flanges 30 and 32. The upper webs 24 have a plurality of aligned equispaced square apertures 34, said apertures being of shape and size equal to the cross sectional shape and size of the pickets 12 such that the pickets 12 may be inserted therethrough. The flanges 30 and 32 have a plurality of like equispaced opposed V-shaped notches 36. As depicted in FIG. 3, when assembled, the V-shaped notches 36 frictionally abut with and engage two opposite corners of picket 12.

In order to assemble the fence 10, picket 12 is inserted through a first ornamental cap 18a, into aperture 32 in upper rail 14, as depicted by 2-A. Picket 12 is then inserted through a second ornamental cap 18b and further inserted into aperture 34 in lower rail 16, as depicted by 2-B. The picket is thereby in the assembly position.

Figure 5:
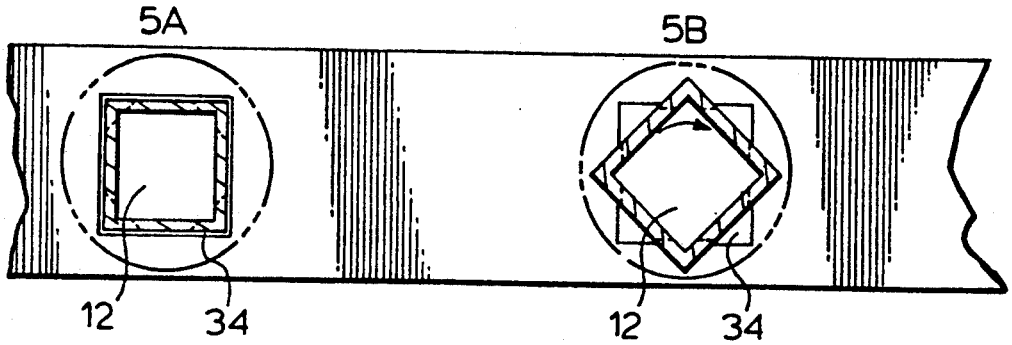
FIG. 5 is a top view of a portion of the fence of FIG. 1 showing a picket-rail interface in assembly position (5-A) and in locking position (5-B).

Picket 12 is then rotated through 45 degrees as demonstrated by the arrow 2-C to the locking position. FIG. 5 depicts a top view of the rotation of picket 12 from assembly position (5A) to locking position (5B). FIG. 3 depicts a cross sectional view of the rotation of picket 12 from assembly position (3A) and (3B) to locking position (3C). Such rotation is enabled by virtue of indentations 22 aligning with upper webs 24. Indentations 22 are of an upper to lower edge length equal to or slightly greater than the thickness of upper web 24, which enables rotation of picket 12 in aperture 34 to occur. Indentations 22 should not be so long as to permit unwanted vertical displacement. Indentation width, or lateral dimension, is equal to at least the difference between the maximum diameter of the picket 12 and the minimum diameter of the aperture 32 divided by two in order to enable rotation from the assembly position to the locking position.

In the locking position, picket 12 frictionally abuts notches 36, thereby preventing or at least resisting subsequent rotation, and indentations 22 engage with edges of aperture 34, thereby preventing vertical and lateral displacement of the picket 12.

Figure 4:
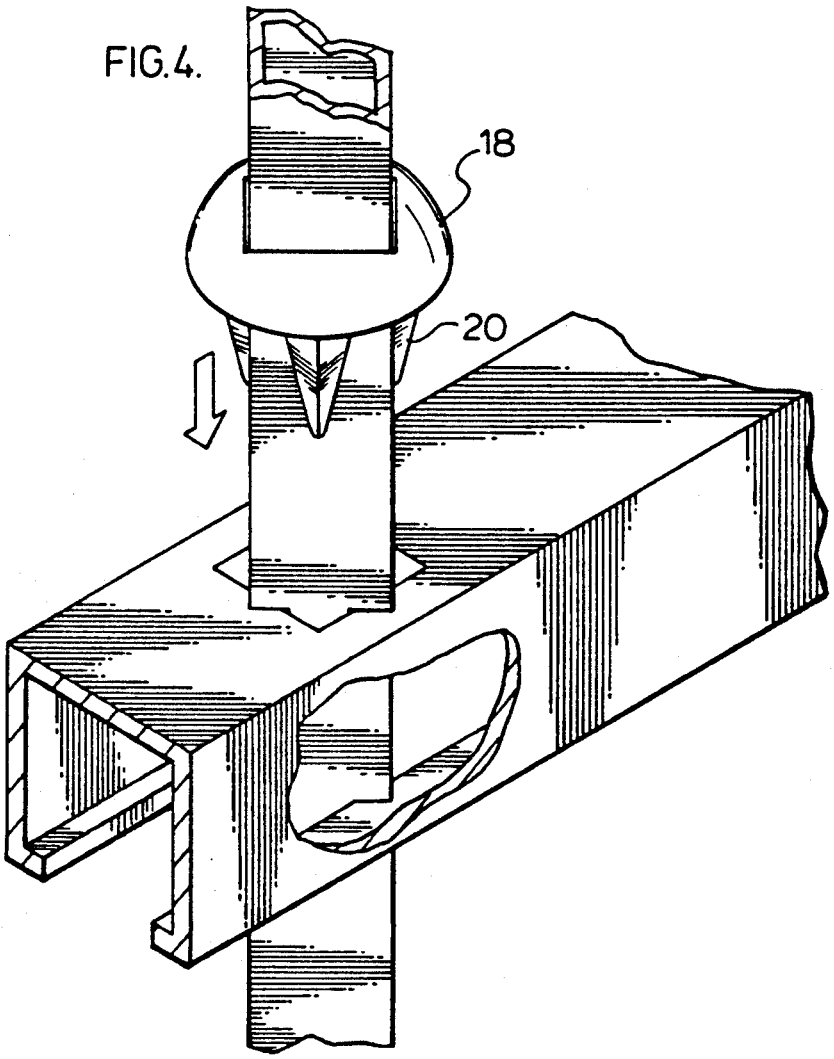
FIG. 4 is a perspective view of a portion of the fence of FIG. 1 showing the connection of a picket to a rail in locking position, cut away to depict the engagement of a corner of a picket with a notch in a rail.

As shown in FIG. 4, once the picket 12 is rotated to the locking position, ornamental caps 18 are pushed downwardly in the direction of the arrow illustrated such that tabs 20 insert into apertures 34 to form a tight smooth joint between picket and rail, thereby further preventing picket displacement, and preventing erosion of the joint through environmental wear and tear. Each picket is inserted and locked into place in the same manner.

As depicted in FIG. 1, the ends of rails 14 and 16 are attached to post 38 by means of an L-shaped metal bracket 40, which receives the rail and attaches to the post 38 using bolts, thereby preventing gaps between rails 14 and 16 and post 38. An ornamental cover 42 is inserted in the end post for decorative and sealing purposes. Further, ornamental caps 44 are inserted on top of each picket 12 for decorative purposes.

While the present invention has been described in connection with a particular embodiment thereof, it will be understood by those skilled in the art that many changes and modifications may be made without departing from the true spirit and scope of the present invention.

I claim:

1. A picket fence assembly comprising in combination: C-shaped upper and lower rails each having lower, spaced-apart, opposed flanges and a plurality of non-circular apertures therethrough in substantial vertical alignment; a plurality of vertically disposed pickets, each extending through one of said apertures in said upper rail and through one of said aligned apertures in said lower rail; said pickets having at least one pair of opposite corners and having thereon upper and lower indentations for engaging the upper and lower rails; said pickets being respectively in said apertures wherein said pickets are axially movable in said apertures to a locking position at which the indentations in the pickets are engaged by the rails and axial movement of said pickets relative to said rails is prevented; said rails being provided with a frictional locking means, wherein said pickets are engaged in a frictional fit therewith in said locking position wherein rotational movement of said pickets is restrained, said frictional locking means comprising a plurality of paired opposed indentations in said opposed flanges, said indentations conforming with the pair of opposite corners whereby said pair opposite corners frictionally abut with and engage the opposed indentations.

2. A picket fence assembly as claimed in claim 1 wherein said indentations are V-shaped notches.

3. A picket fence assembly as claimed in claim 1 wherein said apertures and said pickets are square and wherein said opposed indentations are V-shaped notches for engaging corners of the pickets in frictional abutment.

* * * * *